US005463927A

United States Patent [19]

Lewis

[11] Patent Number: 5,463,927

[45] Date of Patent: Nov. 7, 1995

[54] LOAD ASSIST APPARATUS FOR MISSILES

[75] Inventor: Richard S. Lewis, Chino Hills, Calif.

[73] Assignee: Loral Aerospace Corp., New York, N.Y.

[21] Appl. No.: 285,339

[22] Filed: Aug. 3, 1994

[51] Int. Cl.[6] ..... F41F 5/00

[52] U.S. Cl. ..... 89/1.801; 89/1.819

[58] Field of Search ..... 89/1.801, 1.805, 89/1.815, 1.819

[56] References Cited

U.S. PATENT DOCUMENTS

| | | | |
|---|---|---|---|
| 4,170,923 | 10/1979 | Kilmer | 89/1.819 |
| 4,392,411 | 7/1983 | Minkler | 89/1.819 |
| 4,870,885 | 10/1989 | Grosselin et al. | 89/1.819 |
| 4,926,740 | 5/1990 | Griffin et al. | 89/1.819 |
| 5,094,140 | 3/1992 | Williams | 89/1.819 |
| 5,291,820 | 3/1994 | Hainsworth et al. | 89/1.819 |

FOREIGN PATENT DOCUMENTS

| | | | |
|---|---|---|---|
| 9303321 | 2/1993 | WIPO | 89/1.819 |

*Primary Examiner*—Charles T. Jordan
*Assistant Examiner*—Theresa M. Wesson
*Attorney, Agent, or Firm*—Kenneth W. Float; Anthony W. Karambelas

[57] ABSTRACT

A missile loading system for loading a missile onto a missile launcher disposed on a vehicle. The missile comprises fore and aft missile hangers that each have upper and lower hooks that have a predetermined separation distance therebetween. The improvement provided by the present invention comprises a launch rail disposed on the missile launcher that has two cut-outs disposed a predetermined distance apart that equals the separation distance between the fore and aft missile hangers on the missile. A plurality of load detent mechanisms (fore and aft) are provided that each comprise a body having the shape of the launch rail, and a lip by which the missile is secured, and an opening disposed therein. A plurality of holes are disposed in the body that are used to secure the load detent mechanism the cut-outs in the launch rail. A spring-loaded member having the shape of the launch rail is rotatably secured in the opening of the body. A spring member is coupled between the body and the spring-loaded member that permits it to be depressed.

4 Claims, 2 Drawing Sheets

LOAD ASSIST APPARATUS FOR MISSILES

BACKGROUND

The present invention generally relates to devices for loading a missile onto a missile launcher, and more particularly, to a load detent mechanism and modified launch rail that are used to load a missile onto a missile launcher.

Heretofore, missiles, such as the Chaparral missile manufactured by the assignee of the present invention, are stored in a compartment of a vehicle, for example, and must be removed and loaded onto a launch rail disposed on the vehicle. In the past, it normally takes four people to physically load the missile onto the launch rail. The manner in which this was done in the past is as follows.

The turret of the vehicle is turned so that it is oriented longitudinal to the vehicle. The missile is removed from its storage compartment and four men then carry the missile to the front of the vehicle and lift the missile until slots on the missile engage a track on the launch rail. The missile is then slid the entire length of the launch rail until a firing mechanism engages a locking mechanism at the far end of the missile. Thereafter, canards and wings are attached to the missile after it is locked to the missile launcher.

This procedure is very dangerous in that the missile weighs about 200 pounds and can be damaged if it is dropped, which generally makes the missile inoperative. Also, it is quite difficult to orient and slide the missile onto the track. In many instances, operators have been hurt in attempting to load the missiles in the manner just described.

Therefore, it is an objective of the present invention to provide for a load detent mechanism and modified launch rail that are used to load a missile onto a missile launcher, and that eliminates the problems of the conventional approach outlined above.

SUMMARY OF THE INVENTION

In order to meet the above and other objectives, the present invention provides for a missile loading system for loading a missile onto a vehicle. The missile comprises fore and aft missile hangers that each have upper and lower hooks that have a predetermined separation distance therebetween. The improvement provided by the present invention comprises a launch rail disposed on the vehicle that has two cut-outs disposed a predetermined distance apart equals the separation distance between the fore and aft missile hangers on the missile. A plurality of load detent mechanisms (fore and aft) are provided that each comprise a body having the shape of the launch rail, and a lip by which the missile is secured, and an opening disposed therein. A plurality of holes are disposed in the body that are used to secure the load detent mechanism in the cut-outs in the launch rail. A spring-loaded member having the shape of the launch rail is rotatably secured in the opening of the body. A spring member is coupled between the body and the spring-loaded member that permits it to be depressed.

To load the missile onto the the vehicle, the missile is lifted so that the C-shaped upper hooks on the fore and aft missile hangers engage the upper rail of each of the load detent mechanisms. The missile is then allowed to drop due to its weight so that the C-shaped lower hooks on the fore and aft missile hangers depress the spring-loaded member of the load detent mechanisms. The missile is then slid aftward, and the upper and lower hooks engage the upper and lower portions of the launch rail. The missile is slid aftward until the fore and aft missile hangers engage locking mechanisms on the launch rail and secure the missile thereto. The spring-loaded member then returns from its depressed state once the missile is moved beyond the location of the load detent mechanisms.

BRIEF DESCRIPTION OF THE DRAWINGS

The various features and advantages of the present invention may be more readily understood with reference to the following detailed description taken in conjunction with the accompanying drawings, wherein like reference numerals designate like structural elements, and in which.

DETAILED DESCRIPTION

Figure 1:
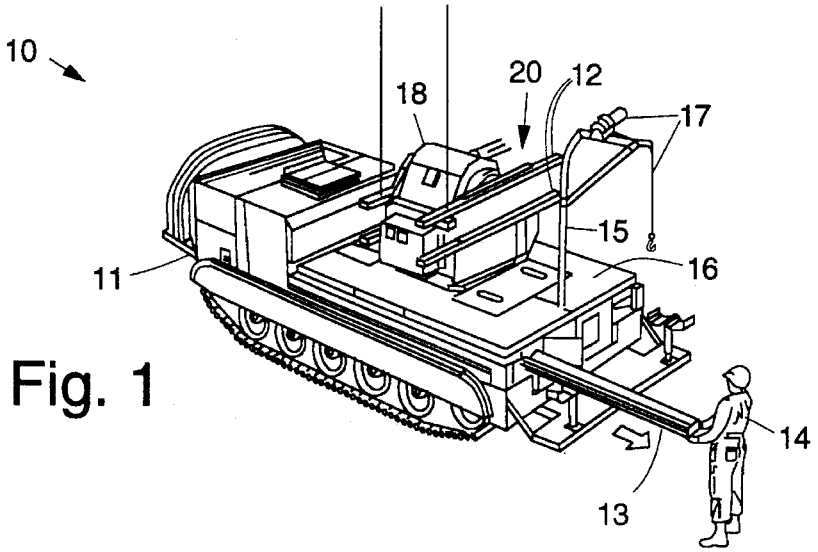
FIG. 1 illustrates a missile loading system for loading a missile onto a vehicle using load detent mechanisms and modified launch rail in accordance with the principles of the present invention.

Referring to the drawing figures, FIG. 1 illustrates a missile loading system 10 for loading a missile 13 onto a missile launcher 18 that is disposed on a vehicle 11. This is achieved using a plurality of load detent mechanisms 20 and a modified launch rail 12 in accordance with the principles of the present invention. The modified launch rail 12 is part of the missile launcher 18. A plurality of load detent mechanisms 20 are used in conjunction with the modified launch rail 12 to load the missile 13 onto the missile launcher 18.

The missile loading system 10 also comprises a boom 15 and hoist 17 that are secured to a deck 16 of the vehicle 11. The boom 15 and hoist 17 are used to support and lift the missile 13 while it is moved from a storage compartment onto the modified launch rail 12. This operation may be performed by one or more operators 14, but no more than two operators 14 are required to load the missile 11 using the present invention. The operation of loading of the missile 11 onto the launch rail 12 will be discussed in more detail below, once a better understanding of the details of the modified launch rail 12 are understood.

Figure 2:
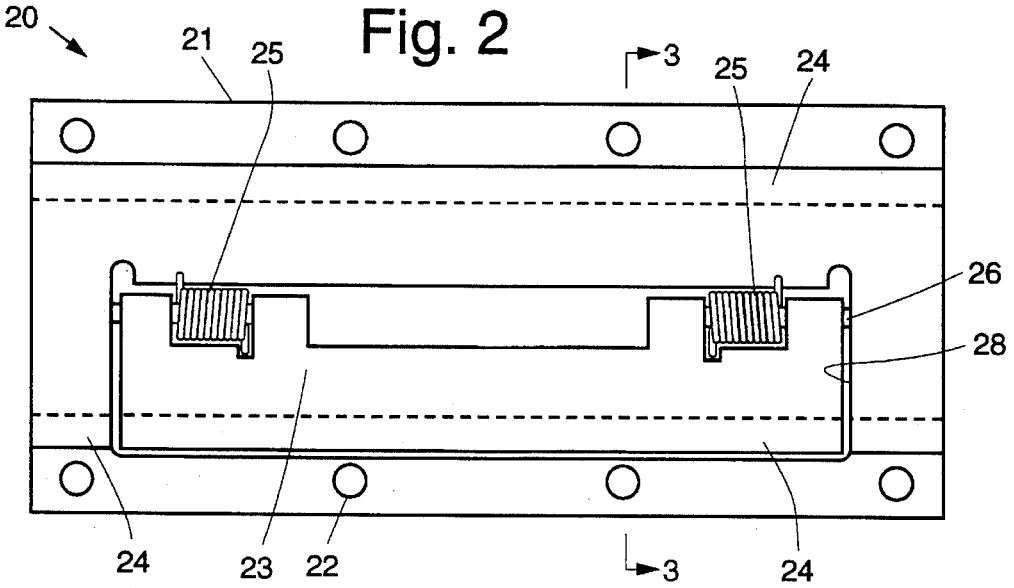
FIG. 2 illustrates a rear view of the load detent mechanism in accordance with the principles of the present invention.
Figure 3:
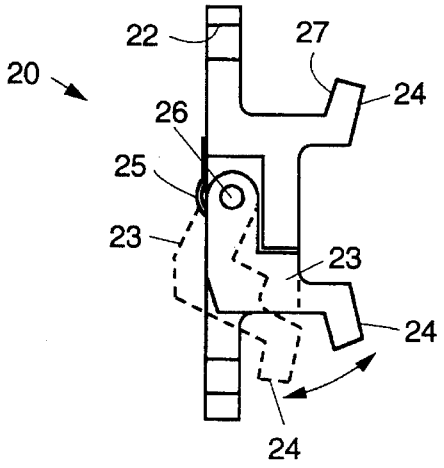
FIG. 3 illustrates a cross sectional end view of the load detent mechanism of FIG. 2, taken along the lines 3—3 of FIG. 2.

FIG. 2 illustrates a rear view of the load detent mechanism 20 in accordance with the principles of the present invention, while FIG. 3 illustrates a cross sectional end view of the load detent mechanism 20, taken along the lines 3—3 of FIG. 2. The load detent mechanism 20 comprises a body, such as is provided by a metal plate or extrusion, for example, having the shape of the launch rail 12 and includes a plurality of holes 22 that are used to secure the load detent mechanism 20 into cut-outs 29 (FIG. 4) in the modified launch rail 12. The load detent mechanism 20 has an opening 28 therein that receives a spring-loaded member 23 that has the shape of the one of the rails 24 of the modified launch rail 12. The spring-loaded member 23 is rotatably secured to the body of the load detent mechanism 20 by means of two shafts 26 and has two coil springs 25 that permit the spring-loaded member 23 to be depressed. This is shown more clearly in FIG. 3, wherein a depressed state of the spring-loaded member 23 is shown in dashed lines, and its motion is represented by the double headed arrow. The horizontal dashed lines in FIG. 2 illustrate a lip 27 of the rail 24 by means of which the missile 13 is secured to the modified launch rail 12.

Figure 4:
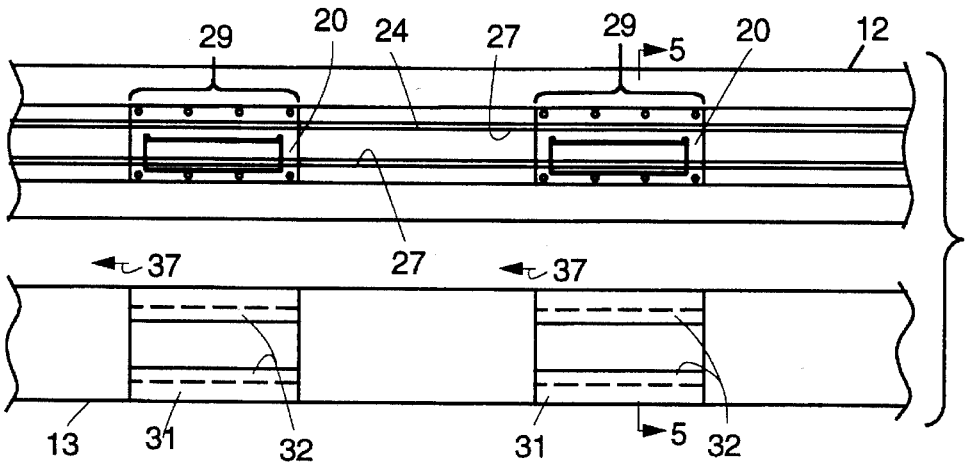
FIG. 4 illustrates a partial view of a launch rail incorporating the load detent mechanism of the present invention and a missile that is to be loaded onto the launch rail.

FIG. 4 illustrates a partial view of the modified launch rail 12 incorporating two load detent mechanisms 20 and shows the missile 13 that is to be loaded onto the modified launch rail 12. The two load detent mechanism 20 are disposed a predetermined distance apart, which distance matches the separation distance between fore and aft missile hangers 31 disposed on the missile 13. The missile 13 is comprised of a circular housing 30 and has the fore and aft missile hangers 31 disposed along its side. The fore and aft missile hangers 31 have C-shaped cross sections that form upper and lower hooks 32 that are adapted to mate with the rails 24 of the modified launch rail 12.

Figure 5:
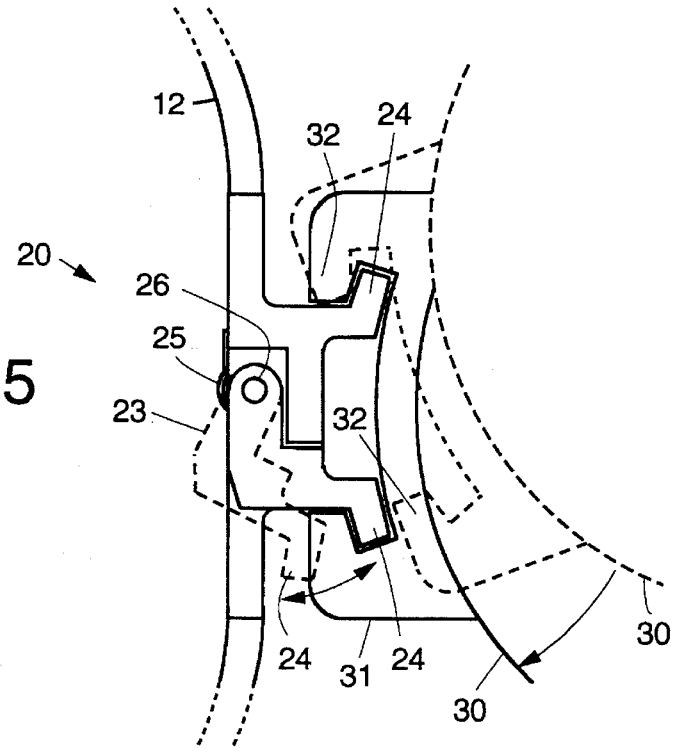
FIG. 5 illustrates loading of the missile onto the modified launch rail using the load detent mechanism of the present invention, taken along the lines 5—5 of FIG. 4.

FIG. 5 illustrates loading of the missile 13 onto modified the launch rail 12 using the load detent mechanism 20, taken along the lines 5-5 of FIG. 4. To load the missile 13 onto the modified launch rail 12, the missile 12 is lifted so that the C-shaped upper hooks 32 on the fore and aft missile hangers 31 engage the upper rail 32 of each of the load detent mechanisms 20. The missile 13 is then allowed to drop due to its weight so that the C-shaped lower hooks 32 on the fore and aft missile hangers 31 depress the spring-loaded member 23. The missile 13 is then slid aftward, illustrated by the arrows 37, and the upper and lower hooks 32 engage the upper and lower rails 32 of the launch rail 12. The missile 13 is slid aftward until the fore and aft missile hangers 31 engage locking mechanisms (not shown) on the launch rail 12 and secure the missile 13 thereto. The spring-loaded member 23 then returns from its depressed state once the missile 11 is moved beyond the location of the load detent mechanism 20.

Thus there has been described a new and improved load detent mechanism and launch rail modification that are used to assist a operator to load a missile onto a missile launcher. It is to be understood that the above-described embodiment is merely illustrative of some of the many specific embodiments that represent applications of the principles of the present invention. Clearly, numerous and other arrangements can be readily devised by those skilled in the art without departing from the scope of the invention.

What is claimed is:

1. A missile loading system for loading a missile onto a missile launcher disposed on a vehicle, wherein the missile comprises fore and aft missile hangers that each comprise upper and lower hooks that have a predetermined separation distance therebetween, wherein the improvement comprises:

a launch rail disposed on the missile launcher that comprises a plurality of cut-outs disposed a predetermined distance apart that equals the separation distance between the fore and aft missile hangers disposed on the missile; and a plurality of load detent mechanisms that each comprise:

a body having the shape of the launch rail, and having a lip by which the missile is secured, and having an opening disposed therein;

a plurality of holes disposed in the body that are used to secure the load detent mechanism in the cut-outs in the launch rail; and a depressible rail member having the shape of the launch rail rotatably secured in the opening of the body of the load detent mechanism to permit a spring-loaded member to be depressed.

2. The missile loading system of claim 2 wherein the depressible rail member comprises:

a spring-loaded member having the shape of the launch rail rotatably secured in the opening of the body of the load detent mechanism; and a spring member coupled between the body and the spring-loaded member that permit the spring-loaded member to be depressed.

3. In a missile loading system for loading a missile onto a missile launcher disposed on a vehicle, wherein the missile comprises fore and aft missile hangers that each comprise upper and lower hooks that have a predetermined separation distance therebetween, and wherein a launch rail is disposed on the missile launcher that comprises a plurality of cut-outs disposed a predetermined distance apart that equals the separation distance between the fore and aft missile hangers disposed on the missile, wherein the improvement comprises:

a plurality of load detent mechanisms that each comprise:

a body having the shape of the launch rail, and having a lip by which the missile is secured, and having an opening disposed therein;

a plurality of holes disposed in the body that are used to secure the load detent mechanism in the cut-outs in the launch rail; and a depressible rail member having the shape of the launch rail rotatably secured in the opening of the body of the load detent mechanism to permit a spring-loaded member to be depressed.

4. The invention of claim 3 wherein the depressible rail member comprises:

a spring-loaded member having the shape of the launch rail rotatably secured in the opening of the body of the load detent mechanism; and a spring member coupled between the body and the spring-loaded member that permit the spring-loaded member to be depressed.

* * * * *